US009744680B2

(12) United States Patent
Hawes et al.

(10) Patent No.: US 9,744,680 B2
(45) **Date of Patent: *Aug. 29, 2017**

(54) FLUID DISPENSING HAIR REMOVAL DEVICE

(71) Applicant: The Gillette Company, Boston, MA (US)

(72) Inventors: Christopher Martin Hawes, Reading (GB); Lee Burrowes, Horsell (GB)

(73) Assignee: The Gillette Company, Boston, MA (US)

( * ) Notice: Subject to any disclaimer, the term of this patent is extended or adjusted under 35 U.S.C. 154(b) by 10 days.

This patent is subject to a terminal disclaimer.

(21) Appl. No.: 13/889,667

(22) Filed: May 8, 2013

(65) Prior Publication Data

US 2014/0331509 A1 Nov. 13, 2014

Related U.S. Application Data

(63) Continuation of application No. 12/581,386, filed on Oct. 19, 2009, now Pat. No. 8,458,909.

(60) Provisional application No. 61/106,266, filed on Oct. 17, 2008.

(51) Int. Cl.
*B26B 21/44* (2006.01)

(52) U.S. Cl.
CPC ..... *B26B 21/446* (2013.01)

(58) Field of Classification Search
CPC ..... B26B 21/446
See application file for complete search history.

(56) References Cited

U.S. PATENT DOCUMENTS

| | | | | |
|---|---|---|---|---|
| D25,575 | S | 6/1896 | Fletcher | |
| D102,422 | S | 12/1936 | Fuerst | |
| 2,288,162 | A * | 6/1942 | Hulst | 30/34.2 |
| 2,327,192 | A | 8/1943 | Keene | |
| 3,088,470 | A * | 5/1963 | Hall | 401/11 |
| D224,642 | S | 8/1972 | Mascia | |
| 4,148,139 | A * | 4/1979 | Allen | 30/34.2 |
| 4,753,006 | A | 6/1988 | Howe | |
| D315,101 | S | 3/1991 | Goldstein et al. | |
| 5,168,628 | A | 12/1992 | Mock et al. | |
| 5,182,857 | A * | 2/1993 | Simon | 30/34.05 |
| 5,337,478 | A * | 8/1994 | Cohen et al. | 30/41.5 |

(Continued)

FOREIGN PATENT DOCUMENTS

| | | |
|---|---|---|
| DE | 101 17 766 A1 * | 10/2002 |
| FR | 2 629 385 | 3/1988 |

(Continued)

*Primary Examiner* — Hwei C Payer

(74) *Attorney, Agent, or Firm* — Ronald T. Sia; Kevin C. Johnson; Steven W. Miller

(57) ABSTRACT

A hair removal device is provided, comprising a handle and a collapsible reservoir suitable for containing a fluid to be dispensed during use of the hair removal device, the hair removal device additionally comprising a container enclosing the collapsible reservoir, a fluid outlet adapted to allow fluid to exit both the collapsible reservoir and the container, an orifice adapted to allow air to flow in or out of the container, and a suction device, adapted to suck fluid out of the collapsible reservoir through fluid outlet, wherein the fluid outlet comprises an applicator. The container can be rigid, deformably rigid, or a combination of both.

11 Claims, 5 Drawing Sheets

(56) References Cited

U.S. PATENT DOCUMENTS

| | | | | |
|---|---|---|---|---|
| 5,402,573 | A | 4/1995 | Laniado | |
| 5,533,266 | A | 7/1996 | Kelman | |
| 5,596,354 | A | 1/1997 | Murphy | |
| 5,704,503 | A | 1/1998 | Krishnakumar et al. | |
| D399,601 | S * | 10/1998 | Desnos et al. | D28/7 |
| D409,922 | S | 5/1999 | Jones et al. | |
| 5,993,180 | A | 11/1999 | Westerhof et al. | |
| 6,312,436 | B1 | 11/2001 | Rijken et al. | |
| D466,408 | S | 12/2002 | Baerenwald et al. | |
| 6,604,879 | B2 | 8/2003 | Gueret | |
| 6,665,937 | B2 | 12/2003 | Furst et al. | |
| 6,789,321 | B2 | 9/2004 | Simms | |
| D499,207 | S | 11/2004 | Angeletta | |
| D499,208 | S | 11/2004 | Angeletta | |
| 6,838,138 | B1 | 1/2005 | Akiyama et al. | |
| D502,394 | S | 3/2005 | Jackson et al. | |
| 6,910,274 | B1 | 6/2005 | Pennella et al. | |
| 6,913,606 | B2 | 7/2005 | Saitou et al. | |
| 6,925,716 | B2 | 8/2005 | Bressler et al. | |
| D509,727 | S | 9/2005 | Suckle et al. | |
| 6,964,097 | B2 | 11/2005 | Franzini et al. | |
| 7,021,495 | B2 | 4/2006 | De Laforcade | |
| 7,121,754 | B2 | 10/2006 | Bressler et al. | |
| D531,798 | S | 11/2006 | Ringo | |
| D568,739 | S | 5/2008 | Darr | |
| 7,530,978 | B2 | 5/2009 | Okawa | |
| D611,351 | S | 3/2010 | Mansau | |
| 7,788,810 | B2 | 9/2010 | Noble | |
| D624,815 | S | 10/2010 | Hansen et al. | |
| 7,931,148 | B2 | 4/2011 | Hansen et al. | |
| 8,444,416 | B2 * | 5/2013 | Chenvainu et al. | 433/80 |
| 8,458,909 | B2 * | 6/2013 | Hawes et al. | 30/41 |
| 2005/0067432 | A1 | 3/2005 | Bonneyrat | |
| 2005/0138814 | A1 | 6/2005 | Pennella et al. | |
| 2005/0144785 | A1 | 7/2005 | Bressler et al. | |
| 2005/0144786 | A1 * | 7/2005 | Bressler et al. | 30/41 |
| 2006/0150386 | A1 | 7/2006 | Wanli et al. | |
| 2006/0240380 | A1 * | 10/2006 | Chenvainu | A46B 11/0079 433/80 |
| 2009/0183371 | A1 | 7/2009 | Mileti et al. | |
| 2010/0095528 | A1 | 4/2010 | Hawes et al. | |
| 2010/0243677 | A1 | 9/2010 | Lim | |
| 2010/0276447 | A1 | 11/2010 | Patrini | |
| 2011/0048451 | A1 | 3/2011 | Breese | |
| 2011/0219621 | A1 | 9/2011 | Royle et al. | |
| 2011/0289776 | A1 | 12/2011 | Hawes et al. | |
| 2014/0331509 | A1 * | 11/2014 | Hawes et al. | 30/535 |

FOREIGN PATENT DOCUMENTS

| | | |
|---|---|---|
| GB | 2 246 314 A | 1/1992 |
| JP | 10 165668 A | 6/1998 |

* cited by examiner

FLUID DISPENSING HAIR REMOVAL DEVICE

FIELD OF THE INVENTION

The present invention concerns hair removal devices, such as razors, which are capable of dispensing a fluid during use.

BACKGROUND OF THE INVENTION

Shaving devices capable of dispensing a fluid, such as a shaving preparation or a lubricant are known, but have a number of shortcomings.

A problem associated with some prior art fluid-dispensing razors is that the fluid is loaded directly into a reservoir disposed within the razor such that, on dispensing, it may be replaced by and come into contact with ambient air or, alternatively, it may directly contact the dispensing mechanism. These kinds of executions raise the prospect of contamination, which, for a device such as a razor, is a problem that must be avoided, especially if fluid remains in the razor between shaves, allowing microbial build-up. Such an execution is known from WO 05/058560 A1.

FR-A-2 629 385 discloses a razor having an aerosol cartridge. Such devices are complex and expensive to produce. They also pollute the atmosphere with propellants and, in addition, aerosol canisters are generally not reusable, so must also be disposed of as well. This patent application also suggests replacing the pressurized cartridge with a liquid pump, but provides no details of either how to achieve that, or how to do so in a manner that maintains the product to be dispensed sterile.

WO 05/058560 A1 discloses a fluid dispensing razor having a flexible bladder filled with shaving aid located in the handle. On actuating a button in the handle, a ratchet mechanism advances a piston which compresses the bladder to expel shaving aid through holes located around the shaving blades. This execution is mechanically complex to manufacture and has the disadvantage that the non-uniform application of pressure on the bladder may result in the accumulation of shaving aid in volumes where the pressure is lower, thereby resulting in incomplete emptying of the bladder during use.

WO 05/065897 discloses an arrangement comprising a bladder filled with shaving aid. A pinch roller driven by a drive mechanism serves to compress the bladder and expel the shaving aid. This arrangement is technically very complex.

Reference can also be made to GB 2 246 314 A, which teaches a razor in which a tubular sack of soap is disposed in the handle. Upon squeezing pressure plates in the handle, spring plates are, in turn, pressurized which squeeze the sack to force soap through holes in the shaving head. Once again, the non-uniform application of pressure to the external surface of the sack may cause soap to accumulate in volumes of lower pressure such that it may not be possible completely to empty the sack during use.

US 2006/0150386 A1 teaches a similar arrangement to that disclosed in the preceding patent application. According to this patent application, a razor is taught in which a flexible bladder comprising shaving agent is located within the handle. Dispensing takes place by squeezing flexible regions of the handle which act directly on the bladder to compress it and expel shaving agent. Once again, dispensing in this manner may result in incomplete emptying of the bladder and a concomitant waste of shaving agent.

It would be desirable to provide a fluid-dispensing hair removal device, which is mechanically simple to construct, which does not allow the fluid to come into contact with ambient air or the dispensing mechanism and which permits a more complete dispensing of fluid during use than traditional fluid-dispensing hair removal devices.

SUMMARY OF THE INVENTION

A hair removal device is provided, comprising a handle and a collapsible reservoir suitable for containing a fluid to be dispensed during use of the hair removal device, the hair removal device additionally comprising a container enclosing the collapsible reservoir, a fluid outlet adapted to allow fluid to exit both the collapsible reservoir and the container, an orifice adapted to allow air to flow in or out of the container, and a suction device, adapted to suck fluid out of the collapsible reservoir through fluid outlet. The container can be a deformably rigid container or a rigid container depending on desired application. In one embodiment, one portion of the device comprises a deformably rigid portion, and another portion of the device comprises a rigid portion.

BRIEF DESCRIPTION OF THE DRAWINGS

in FIG. 3A, pump system is in fluid dispensing mode.

DETAILED DESCRIPTION OF THE INVENTION

Figure 1:
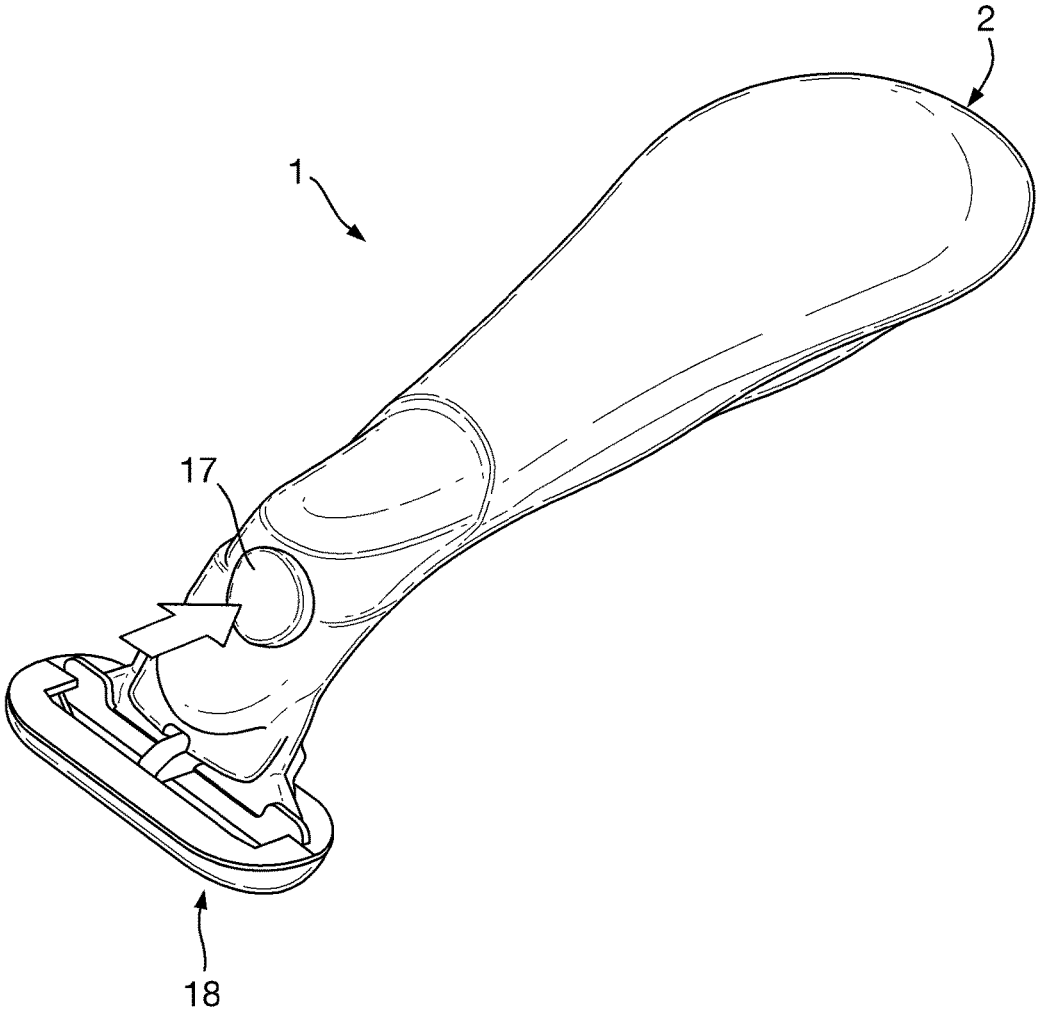
FIG. 1 is a perspective view of a razor according to the present invention.

Hair removal devices according to the present invention comprise fluid disposed within a collapsible reservoir which reservoir is, itself, enclosed within a container. The container which encloses the collapsible reservoir must be sufficiently rigid not to collapse at the same time as the collapsible reservoir. In one embodiment the container is deformably rigid. Suitably deformably rigid materials of construction of the container include polyethylene, polypropylene, PET, PVC, and mixtures thereof. In another embodiment the container is rigid such that is not easily deformed by hand pressure such as squeezing or pressing. The rigid container may be particularly suitable when an actuator and pump are used. The container may be comprised within the handle of the fluid-dispensing hair removal device or, indeed, the handle of the fluid-dispensing hair removal device may itself define the container. If the handle defines the container, then the handle must be sufficiently rigid not only to retain its shape as the collapsible reservoir collapses, but also to function as a handle.

The collapsible reservoir may be manufactured separately from and then introduced into the container or the two may be manufactured together in a single process.

In one preferred manufacturing process, the two are manufactured together in a single process, such that, following manufacture and prior to use, the collapsible reservoir is removably laminated to the container. An exemplary process includes extrusion blow molding of a multi-layer parison comprising an outer layer, which will become the container, an inner layer, which will become the collapsible reservoir and an intermediate layer, between the inner layer and the outer layer, which serves to prevent the inner and outer layers from permanently adhering to one another. The intermediate layer may extend over the entire interfacial surface between the inner and outer layers, or may be left out at some important locations at the interface, such as at a fluid outlet, in order to effect bonding between the inner and outer layers at that or those locations and thereby prevent delamination in those locations. During the manufacturing process, the multi-layer parison is extruded and then blown. In subsequent use, air forced between the inner and outer layers acts to "delaminate" or peel away the inner layer forming the collapsible reservoir. The collapsible reservoir thereby becomes separated from the outer layer forming the container, while the outer layer enclosing the collapsible reservoir essentially retains its shape.

In an alternative, preferred manufacturing process, injection-moulded inner and outer pre-forms are assembled together and then subsequently blow-moulded to form the collapsible reservoir and the container.

Typical materials of construction of the collapsible reservoir include nylon, PET, PVC, LDPE polypropylene, and mixtures thereof. If the collapsible reservoir and the container enclosing it are made of similar or identical materials, then the necessary differences in rigidity will be achieved in ways known to the skilled person, such as via differences in wall thicknesses. Reference may be made to the following documents which discuss technologies for making so-called "delaminating" or "multi-layer" containers: U.S. Pat. No. 5,316,135; U.S. Pat. No. 6,244,852; U.S. Pat. No. 6,109,468; U.S. Pat. No. 5,435,452; U.S. Pat. No. 5,513,761; U.S. Pat. No. 5,567,377; U.S. Pat. No. 5,711,454; U.S. Pat. No. 5,921,438; U.S. Pat. No. 6,691,494; U.S. Pat. No. 6,266,943; U.S. Pat. No. 6,691,494; U.S. Pat. No. 6,266,943; U.S. Pat. No. 6,670,007.

The fluid comprised within the collapsible reservoir must be allowed to exit the collapsible reservoir and the container for use during the hair removal process. To facilitate this, an opening is provided in the collapsible reservoir and a further opening is provided within the container and these openings are aligned with one another and connected together during the manufacturing process to provide a fluid outlet. The collapsible reservoir may be connected to the container at the fluid outlet in ways known to the person skilled in the art. One such way is described above and involves the collapsible reservoir and the container being bonded together during the manufacturing process by virtue of their comprising materials which naturally bond and by virtue of omitting any intermediate layer in the vicinity of the fluid outlet to prevent such bonding. More typically, the collapsible reservoir and the container are arranged such as to be mechanically pressed together at the fluid outlet. For example, the relative sizes of the container and the collapsible reservoir at the fluid outlet may be such that they are forced together. If the collapsible reservoir and the container are manufactured together in a single manufacturing process, then a mechanical connection may automatically result from that manufacturing process.

Advantageously, the hair removal device according to the invention comprises a first one-way valve in order to allow fluid to exit but not enter the collapsible reservoir. This has the advantage of reducing the possibility of contamination of the fluid by contaminated air or by contaminated fluid being drawn back into the collapsible reservoir. Suitable one-way valves include duck-bill valves, flapper valves, ball valves, slit valves and umbrella valves.

In order to dispense fluid, the hair removal device must comprise a suction device suitable for sucking fluid out of the collapsible reservoir via the fluid outlet. Suitable suction devices are known to the person skilled in the art. Advantageously, the suction device is a pump and preferably an airless pump. As used herein, the term "airless pump" means a pump that can dispense fluid without ingress of air to replace fluid being dispensed. Such pumps have the advantage that they maintain the fluid to be dispensed sterile. Airless pumps are known to the person skilled in the art.

Advantageously, the suction device facilitates the delivery of an accurately repeatable dosage of fluid from the hair removal device. Such a dosage may be at any desirable level, but is advantageously from 0.001 to 4 ml.

One embodiment of an airless pump comprises a chamber having a chamber inlet, through which fluid may enter the chamber, a chamber outlet and a piston which extends across the chamber, the piston having a shaft extending through the chamber outlet in a fluid-tight fashion, wherein a second one-way valve is disposed at the chamber inlet to allow fluid to enter, but not exit the chamber, and the piston comprises a hollow bore, through which fluid may exit the pump, the first one-way valve, referred to above, being located in the bore. Resilient means located on the piston shaft, serve to exert a biasing force biasing the piston towards the chamber outlet.

In use, a depression force is applied by a user to the piston to move it towards the chamber inlet. This, in turn, causes fluid in the chamber to exit the chamber through the hollow bore and out via the first one-way valve. During this phase, the second one way valve is forced shut, so that fluid may not be forced out of the chamber back into the collapsible reservoir. Once the depression force is removed, the resilient means serve to move the piston back towards the chamber outlet, which in turn creates an under-pressure in the chamber, which acts to close the first one-way valve and open the second one-way valve and draw fluid out of the collapsible reservoir and into the chamber.

The means for applying a depression force to the piston may be configured as a button located on the handle of the hair removal device, which button is manually operable by a user of the hair removal device, such that depressing the button directly applies a depression force to the piston shaft.

More preferably, the razor cartridge itself is reciprocally received on the handle, such that the razor cartridge itself is the pump actuator and depressing it effects fluid dispensing. This execution has the advantage of being technically the simplest to realize because neither a button nor a flexible tube linking the pump to the razor cartridge is required. To facilitate easy actuation, a portion of the razor head may be configured as a finger or thumb pad, to render it convenient for a user to apply the necessary depression force. Alternatively, the force applied by the user in bringing the cartridge in contact with and moving it across the skin may be sufficient to depress the cartridge and effect actuation of the pump.

Once fluid leaves the fluid outlet it enters the head of the hair removal device to be distributed onto the skin of the user. This may take place through one or more holes or slits in the skin-facing surface of the head.

In one embodiment, the head of the hair removal device comprises an applicator for dispensing the fluid. In one embodiment, the applicator is flat and wide for dispensing a thin but wide ribbon of the fluid. In one embodiment, the applicator forms a dispensing orifice comprising a smaller orifice dimension having a length of from about 0.5 mm to about 10 mm, alternatively from about 1 mm to about 3 mm, and a larger orifice dimension having a length of from about 20 mm to about 80 mm, alternatively from about 30 mm to about 70 mm, alternatively from about 40 mm to about 50 mm. Preferably, the smaller orifice dimension is a vertical dimension and the larger orifice dimension is a horizontal dimension. The smaller and larger orifice dimensions are measured as the vertical and horizontal distances, respectively between opposing edges of the applicator which forms the orifice. This type of applicator is particularly suitable when the device contains a depilatory, a lubricating fluid, a moisturizer, or any other suitable hair removal composition. In one embodiment, the applicator has a spreading member which is separate from the dispensing orifice. When a spreading member is used, the device can dispense the fluid via one or more holes or slits which can be positioned proximally towards the handle (where the spreading member is positioned distally away from the container) such that when the user is pulling the device in a direction towards the handle, fluid can be dispersed and the spreading member can be used to spread the fluid onto the skin surface. In one embodiment, the spreading member has a length of from about 20 mm to about 80 mm, alternatively from about 30 mm to about 70 mm, alternatively from about 40 mm to about 50 mm.

In one embodiment, the applicator and/or spreading member if present has a skin contacting edge which is flat, concave or convex. Those of skill in the art will understand that different shapes for the skin contacting edge can be preferred based on the desired part of the body upon which the device is intended for use. For example, a hair removal device intended for use on the face may have an applicator having a straight edge. A hair removal device intended for use on legs may have an applicator having a concave edge. Non-limiting examples of suitable head configurations are disclosed in U.S. Design Pat. Nos. D399,601 to Desnos, D203,892 to Muscatiello, and U.S. Pat. No. 651,420 to Haglock; U.S. Pat. Nos. 3,088,470 to Hall, 3,858,985 to Fiveash, 2004 0168743A1 to Garwood; WO Publ. No. 97/18043A1 to Weiss; and GB 1 390 153 to Laboratorio Guidotti & C.S.p.A.

Those of skill in the art will understand that the applicator can also serve as a dispensing member for a second fluid. In one embodiment, the applicator would include a slit type orifice which could remain in a closed orientation until pressure is applied, opening the slit type orifice and allowing fluid to dispense.

The handle of the hair removal device may be permanently or removably fixed to the hair removal device. Advantageously, the handle is detachable from the hair removal device. If the handle comprises the container enclosing the collapsible reservoir, then such an arrangement facilitates replacement of the collapsible reservoir. In such a case, if the reservoir is empty, then the handle, comprising the container and collapsible reservoir are simply removed and replaced by a new handle comprising a container enclosing a new collapsible reservoir which is full of fluid. The empty handle can then be recycled.

The fluid-dispensing hair removal device according to the invention may be a shaving device, such as a razor, but is not limited to such devices and may instead be a device which employs other means, such as light, especially laser light, or even depilatories (as disclosed in U.S. Pat. Nos. 4,618,344, 5,645,825A, 6,743,419, and US Patent Publication US2004/0228820A1) to remove hair. In one embodiment, the device includes a scraper or scraping edge which can help facilitate hair removal. Like the spreading edge, the scraper or scraping edge can be straight, concave or convex shaped.

For the event that the hair removal device is a razor, then the razor cartridge comprising the blades may be permanently or removably fixed to the hair removal device. Advantageously, the cartridge is detachable from the hair removal device, such that it may be replaced, as needed.

The fluid comprised within the reservoir of the hair removal device is advantageously a cosmetic fluid, more preferably a shaving preparation. Examples of such fluids include, but are not limited to; oil-in-water emulsions, water-in-oil emulsions, single phase aqueous polymer solutions, high level surfactant based solutions. Within such fluids, additional ingredients may be incorporated, examples of which include: high molecular weight polymers, cationically charged polymers, lipid based materials, silicone based compounds, surfactants, vitamins and vitamin derivatives, skin conditioning agents, hair removal waxes, other hair removal compositions, and depilatories.

Those skilled in the art will appreciate that this device could comprise a deformably rigid or rigid container. The rigid container would require a suction device in order to draw the fluid from the collapsible reservoir. A deformably rigid container could have external pressure applied to it in order to compress the air in said container and thus dispense fluid from the collapsible reservoir. Moreover the container could be dispensed by actuating the pump or by applying external pressure to the body of the device in the same embodiment, thus providing the user with alternative dispensing options.

Reference is made to the figures, which disclose a non-limiting embodiment of the invention.

FIG. 1 illustrates a hair removal device (1) in the form of a razor, comprising a handle (2) and a razor cartridge (18), itself comprising blades (not shown), and a button (17) for dispensing fluid.

Figure 2A:
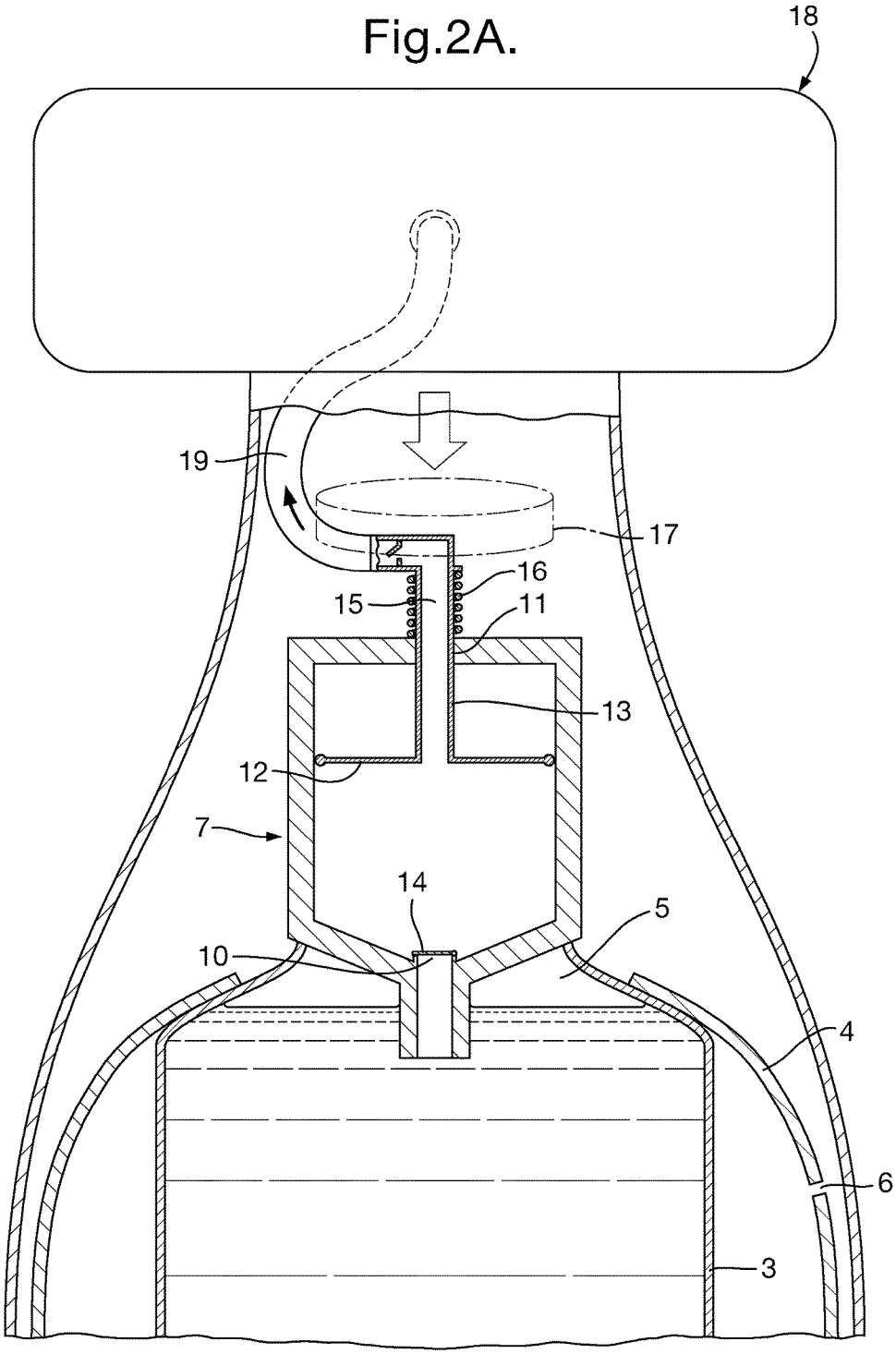
FIG. 2A is a schematic view of a razor according to the present invention, illustrating a pump system in fluid dispensing mode.
Figure 2B:
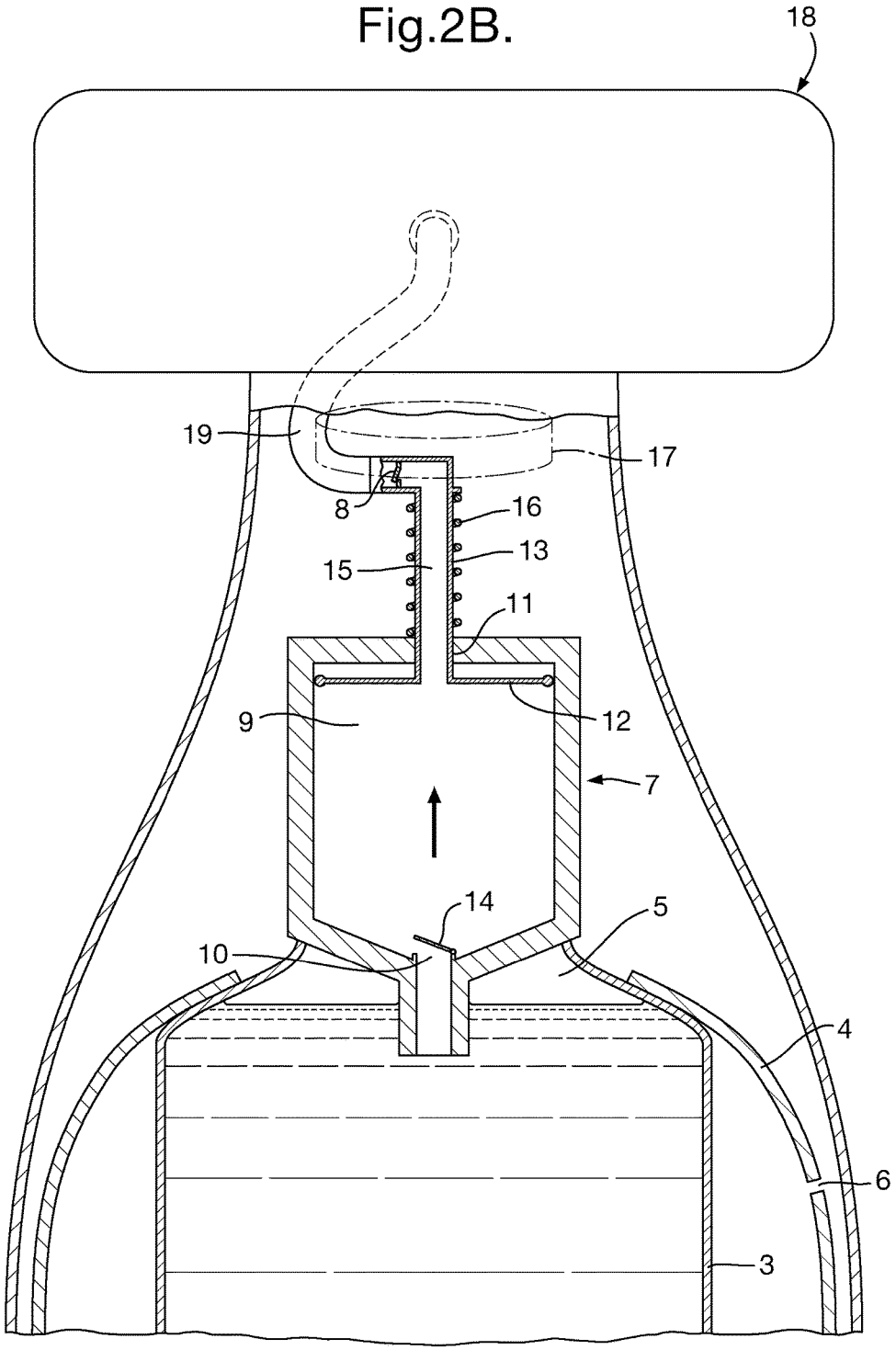
FIG. 2B is a schematic view of the razor according to FIG. 2A, illustrating a pump system in fluid intake mode.

FIGS. 2A and 2B are schematic drawings, illustrating one way of executing the embodiment shown in FIG. 1. These figures show a flexible reservoir (3) comprising a fluid, the reservoir being enclosed by a container (4), both the flexible reservoir (3) and the container (4) having aligned openings which, together, form a fluid outlet (5) through which fluid may exit the collapsible reservoir (3) and container (4). One or more orifice(s) (6) in the container (4) allow air to flow into the container, thereby permitting pressure compensation as the collapsible reservoir (3) collapses.

FIGS. 2A and 2B also show a suction device (7) which is configured, in this case, as an airless pump. The airless pump comprises a chamber (9) having a chamber inlet (10), through which fluid may enter the chamber (9), a chamber outlet (11) and a piston (12) which extends across the chamber (9), the piston (9) having a piston shaft (13) extending through the chamber outlet (11) in a fluid-tight fashion, wherein a second one-way valve (14) is disposed at the chamber inlet (10) to allow fluid to enter, but not exit the chamber. The piston comprises a centrally located piston orifice to allow fluid to pass through the piston. In addition, the piston shaft (13) comprises a hollow bore (15), which is fluidly connected to the piston orifice such that fluid may flow through the piston orifice, into the hollow bore (15) and exit the pump. A first one-way valve (8) is located in the hollow bore (15) to allow fluid to exit but not re-enter the hollow bore (15). Resilient means (16) located on the piston shaft (13), serve to exert a biasing force biasing the piston (12) towards the chamber outlet (11). The resilient means are configured as a coil spring in these figures, but may, alternatively, be configured in alternative ways known to the person skilled in the art.

The airless pump may be actuated by applying a depression force to button (17), shown in dotted lines, to expel fluid from the airless pump, through first one-way valve (8) and into flexible tube (19), which connects the airless pump with the razor head (18), from which it is dispensed onto the skin of the user. This may take place through one or more holes or slits (not shown) in the skin-facing surface of the head.

In use, a depression force is applied by a user to button (17), which transmits the force via piston shaft (13) to piston (12) to move it towards the chamber inlet (10). This, in turn, causes fluid in the chamber (9) to exit the chamber (9) through the hollow bore (15) of the piston shaft (13) and out via the first one-way valve (8). During this phase, the second one way valve (14) is forced shut by the depression force exerted by piston (12) and transmitted through the fluid, so that fluid may not be forced out of the chamber back into the collapsible reservoir (3). Once the depression force is removed, the resilient means (16) serve to move the piston (12) back towards the chamber outlet (11). This, in turn, creates a pressure drop in the chamber (9), which acts to close the first one-way valve (8) and open the second one-way valve (14) and draw fluid out of the collapsible reservoir (3) and into the chamber (9) to replenish it in readiness for the next actuation of the pump. As the collapsible reservoir (3) collapses, air is drawn into the container (4) via orifice(s) (6) to compensate for the reduced volume of the collapsible reservoir (3).

Figure 3A:
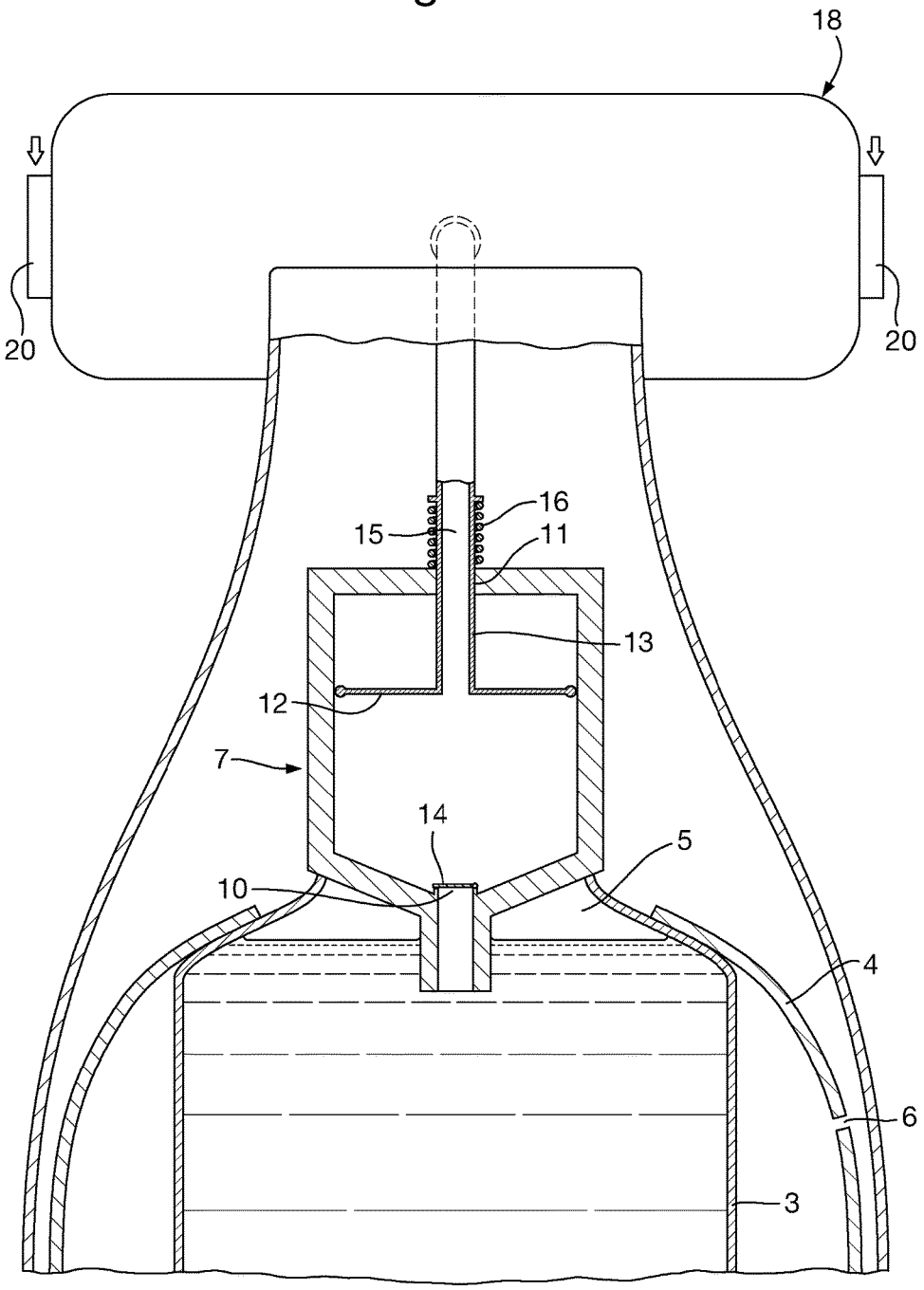
FIG. 3A is a schematic view of a razor according to the present invention having an alternative pump actuation mechanism to the razor shown schematically in FIGS. 2A and 2B.
Figure 3B:
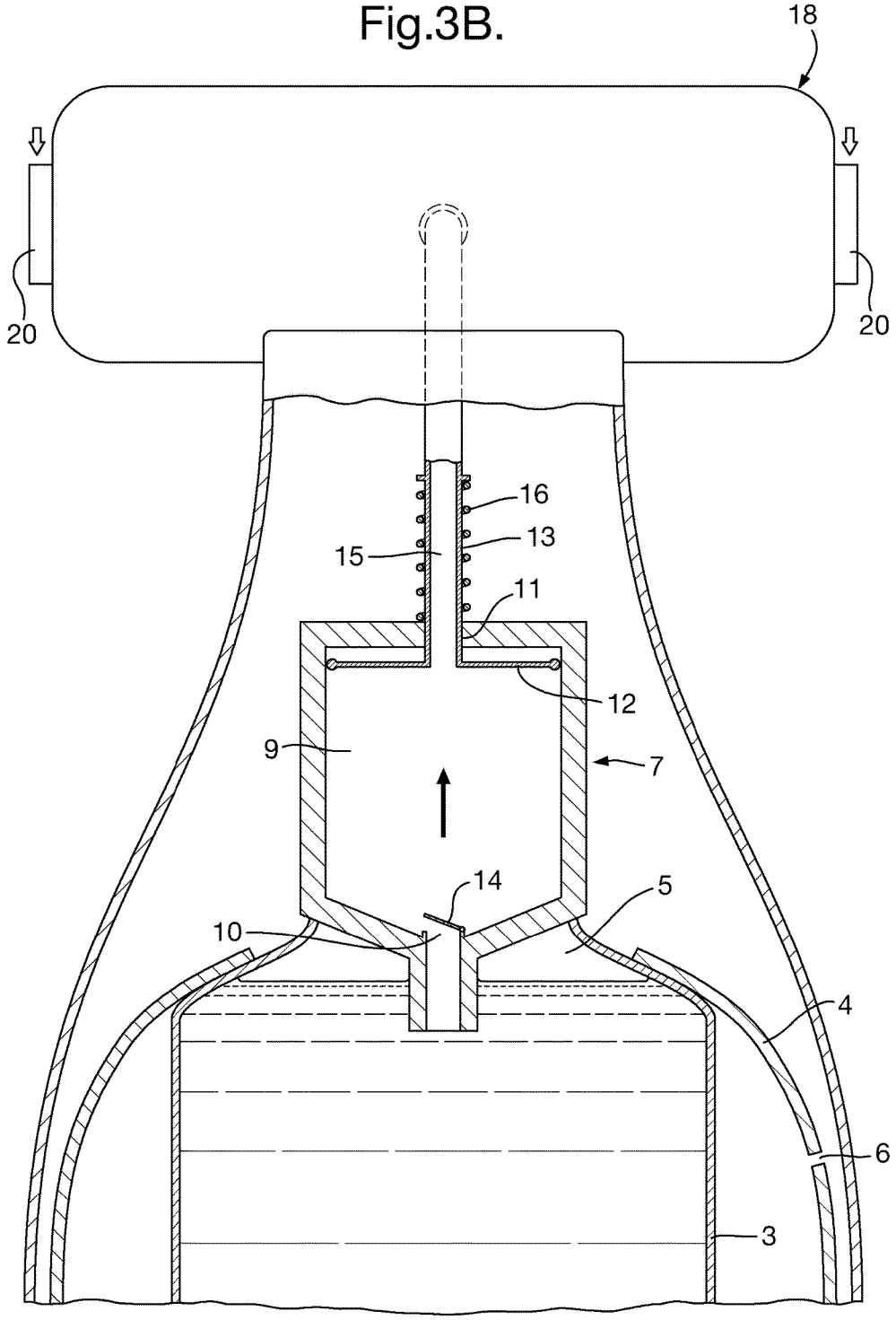
FIG. 3B is a schematic view of a razor according to FIG. 3A, illustrating a pump system in fluid intake mode.

FIGS. 3A and 3B are schematic drawings illustrating an alternative way of actuating the suction device (7). Numbered features in these figures are the same and have the same function as features having the same number in FIGS. 2A and 2B. The difference between the embodiment of FIGS. 2A and 2B on the one hand and FIGS. 3A and 3B on the other is that actuation of the pump is not effected by a depressing a button, but by movement of the razor cartridge (18) itself, which is reciprocally received on the handle.

In use of the embodiment of FIGS. 3A and 3B, a depression force is applied by a user to the cartridge (18) to overcome the biasing force of resilient means (16) and depress the cartridge (18) from its rest state. This depression force may be applied essentially as shown by the force arrows depicted in FIG. 3A to finger/thumb pads (20). Alternatively, the force applied by the user in bringing the cartridge (18) into contact with and moving it across the skin may be sufficient to overcome the biasing force of resilient means (16) and depress the cartridge (18) from its rest state. Depression of cartridge (18) transmits an axial force via piston shaft (13) to piston (12) to move it towards the chamber inlet (10). This, in turn, causes fluid in the chamber (9) to exit the chamber (9) through the piston orifice and hollow bore (15) of the piston shaft (13) and out via the first one-way valve (not shown). During this phase, the second one way valve (14) is forced shut by the depression force exerted via piston (12) and transmitted through the fluid, so that fluid may not be forced out of the chamber back into the collapsible reservoir (3). Once the depression force is removed, as shown in FIG. 3B, the resilient means (16) serve to move the cartridge (18) back to its rest state, during which piston (12) is urged back towards the chamber outlet (11). This, in turn, creates a pressure drop in the chamber (9), which acts to close the first one-way valve (not shown) and open the second one-way valve (14) and draw fluid out of the collapsible reservoir (3) and into the chamber (9) to replenish it in readiness for the next actuation of the pump.

An advantage of this embodiment versus embodiments such as that depicted in FIGS. 2A and 2B is that it is technically simpler, requiring no separate button and no flexible tubing linking the razor cartridge with the pump.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair removal device comprising a handle and a collapsible reservoir suitable for containing a fluid to be dispensed during use of the hair removal device, the hair removal device additionally comprising a container enclosing the collapsible reservoir, a fluid outlet adapted to allow fluid to exit both the collapsible reservoir and the container, an orifice adapted to allow air to flow in or out of the container, and a suction device, said hair removal device further comprising a razor cartridge head, said suction device comprising a chamber, said chamber comprising a chamber outlet comprising a first one way valve in fluid communication with said fluid outlet, a chamber inlet comprising a second one way valve in fluid combination with said collapsible reservoir, wherein a pressure applied to said chamber causes said first one way valve to open to allow fluid to dispense from said chamber to said razor cartridge head, while closing said second one way valve, wherein when said pressure is removed, said second one way valve opens to allow fluid to enter said chamber from said collapsible reservoir.

2. The hair removal device of claim 1, wherein the handle comprises the container.

3. The hair removal device of claim 1, wherein the razor cartridge head comprises one or more razor blades.

4. The hair removal device of claim 3, wherein the suction device is a pump, and the razor cartridge head is reciprocally received on the handle, such that applying a depression force to depress the razor cartridge head from its rest state actuates the pump and dispenses fluid onto the skin of a user.

5. The hair removal device of claim 1, wherein the suction device comprises an airless pump which is manually powered.

6. The hair removal device of claim 1, wherein the handle is detachable.

7. The hair removal device of claim 1, containing a shaving preparation.

8. The hair removal device of claim 1, wherein the fluid is a depilatory.

9. The hair removal device of claim 1, wherein the handle is deformably rigid.

10. The hair removal device of claim 1, wherein the handle is rigid.

11. The hair removal device of claim 1, wherein said pressure is a depression force created by a manually actuable button on said handle.

* * * * *